US005696519A

United States Patent [19]

Suzuki et al.

[11] Patent Number: 5,696,519

[45] Date of Patent: Dec. 9, 1997

[54] POLARIZATION ANGLE ADJUSTMENT APPARATUS FOR TRANSMITTER AND RECEIVER EQUIPMENT

[75] Inventors: Takuya Suzuki; Yoshio Minowa, both of Tokyo, Japan

[73] Assignee: NEC Corporation, Japan

[21] Appl. No.: 578,270

[22] Filed: Dec. 26, 1995

[30] Foreign Application Priority Data

Dec. 26, 1994 [JP] Japan ..... 6-322643

[51] Int. Cl.[6] ..... H01Q 3/18

[52] U.S. Cl. ..... 343/761; 343/839; 343/840; 343/882

[58] Field of Search ..... 343/882, 756, 343/761, 839, 781 R, 840; H01Q 3/12, 19/00, 19/10, 3/16, 3/18

[56] References Cited

U.S. PATENT DOCUMENTS

| | | | |
|---|---|---|---|
| 2,457,562 | 12/1948 | Karleen | 343/761 |
| 2,646,508 | 7/1953 | Fisher | 343/761 |
| 4,173,762 | 11/1979 | Thompson et al. | 343/761 |
| 4,786,912 | 11/1988 | Brown et al. | 343/761 |

FOREIGN PATENT DOCUMENTS

| | | |
|---|---|---|
| 7-9445 | 3/1995 | Japan . |
| 7-79275 | 8/1995 | Japan . |

*Primary Examiner*—Michael C. Wimer

*Attorney, Agent, or Firm*—Ostrolenk, Faber, Gerb & Soffen, LLP

[57] ABSTRACT

In a polarization angle adjusting mechanism for an antenna apparatus constructed of a supporting base and a transmitter/receiver apparatus equipped with a primary antenna at a right end portion thereof formed in an integral form, the primary antenna being located at a focal portion of an antenna, the supporting base has a cylindrical bearing for receiving a rotation shaft of the transmitter/receiver apparatus at a left end portion thereof, and also a plurality of subdivided projections are provided on this shaft receiving plane along a circumferential direction. On the other hand, projections and grooves fitted to a plurality of projections provided on the supporting base, which can be inserted among these plural grooves, are provided in the circumferential surface of the rotation shaft of the transmitter/receiver apparatus. The rotation shaft is inserted into the supporting base and the transmitter/receiver apparatus is rotated, so that the projections are fitted to the grooves so as to mount the transmitter/receiver apparatus to the supporting base. Similarly, another supporting base is mounted on the right end portion of the transmitter/receiver apparatus. In this manner, the transmitter/receiver apparatus is rotated to thereby adjust the polarization angle.

9 Claims, 5 Drawing Sheets

FIG. 2
(PRIOR ART)
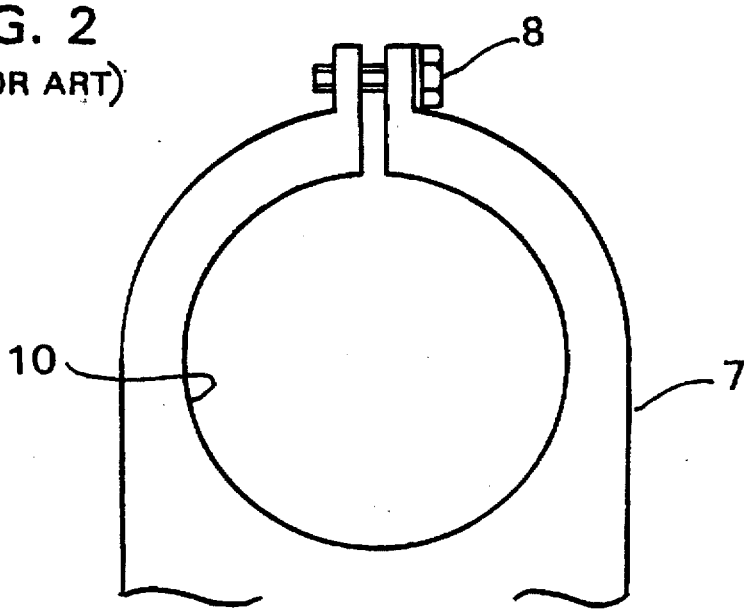
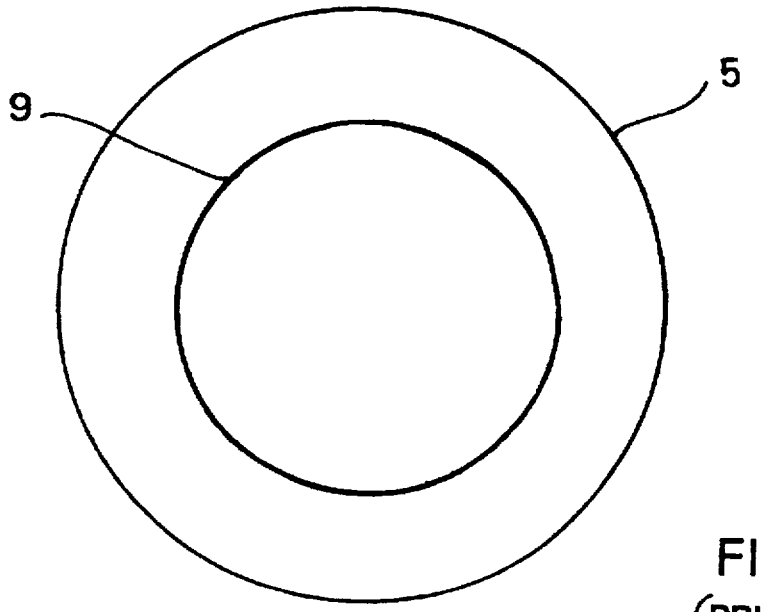
FIG. 3
(PRIOR ART)

POLARIZATION ANGLE ADJUSTMENT APPARATUS FOR TRANSMITTER AND RECEIVER EQUIPMENT

BACKGROUND OF THE INVENTION

The present invention relates to a mechanism for adjusting a polarization angle of an antenna apparatus wherein a transmitter/receiver apparatus for transmitting/receiving a high frequency signal in a microwave band is mounted on an antenna. More specifically, the present invention is directed to a polarization angle adjusting mechanism of a transmitter/receiver apparatus equipped with a primary antenna located at a focal position of a parabolic reflecting mirror.

In FIG. 1, there is shown a side view of one conventional antenna apparatus equipped with a parabolic reflecting mirror. The parabolic reflecting mirror is employed to transmit/receive signals in the microwave band. In this drawing, reference numeral 1 indicates the parabolic reflecting mirror, reference numeral 2 shows the primary antenna, reference numeral 4 denotes an electromagnetic wave radiation axis of the primary antenna 2, and reference numeral 5 indicates a transmitter/receiver apparatus. Also, reference numerals 6 and 7 represent supporting bases having similar shapes to each other and used to support the primary antenna 2 and the transmitter/receiver apparatus 5, reference numeral 8 is a fastening screw, and reference numeral 3 shows a housing for supporting/fixing the parabolic reflecting mirror 1 and the supporting bases 6, 7.

Also, FIG. 2 and FIG. 3 are sectional views of the supporting base 7 and the transmitter/receiver apparatus 5, respectively, as viewed along the front direction. It should be noted that the diameter of a rotation shaft 9 is made slightly smaller than that of cylindrical bearing 10 in order that the rotation shaft 9 of the transmitter/receiver apparatus 5 may be fitted to the cylindrical bearing 10 of the supporting base 7.

Also, as viewed along the back direction, the rotation shaft 9 of transmitter/receiver apparatus 5 is fitted to the cylindrical bearing 10 of the supporting base 6.

FIG. 4 is a sectional view showing in detail, the mount adjusting mechanism employed in one supporting base 7 for mounting the transmitter/receiver apparatus 5, namely the conventional polarization angle adjusting mechanism. This polarization angle adjusting mechanism will now be described with reference to the above-explained drawings.

First, in FIG. 1, both the primary antenna 2 and the transmitter/receiver apparatus 5 are made in an integral form. The primary antenna 2 is located at the focal portion of the parabolic reflecting mirror 1 by way of the housing 3. Both end portions of the transmitter/receiver apparatus 5 are made cylindrical. This transmitter/receiver apparatus 5 is rotatable around the rotation shaft 9 in order that the polarization angle can be adjusted, and is mounted by the supporting bases 6 and 7 provided on the housing 3. The mounting structure of the transmitter/receiver apparatus 5 will now be explained in detail. That is, the rotation shaft 9 at the edge portion of the transmitter/receiver apparatus 5 is received by the cylindrical bearing 10 provided on the supporting base 7. The cylindrical bearing 10 is tightened against the rotation shaft 9 of the transmitter/receiver apparatus 5 by screwing the screw 8 of the upper portion of the supporting base 7, so that the transmitter/receiver apparatus 5 is fixed to the focal portion of the antenna 1.

Generally speaking, as radio signals, a circular polarized wave, a vertical polarized wave, and a horizontal polarized wave are utilized. As a consequence, the polarization angles of the transmitter/receiver apparatus 5 must be adjusted to become optimum angles in accordance with the setting positions of the antenna 1. To this end, the screw 8 of the supporting base 7 is loosened, a space is made between the rotation shaft 9 of the transmitter/receiver apparatus 5 and the cylindrical bearing 10 of the supporting base 7, and the transmitter/receiver apparatus 5 is manually rotated with respect to the supporting base 7 to adjust the polarization angle. The above-described conventional structure is described in, for instance, Japanese Laid-open Utility Model Application No. 1-95812 (corresponding to Japanese Utility Model Publication No. 7-9445), and Japanese Laid-open Patent Application No. 62-179288 (corresponding to Japanese Patent Publication No. 7-79275).

This conventional polarization angle adjusting mechanism has the below-mentioned problems, since the cylindrical rotation shaft provided in the transmitter/receiver apparatus is supported by the cylindrical bearing provided on the supporting base.

As a first problem, when the force produced by tightening the bearing of the supporting base against the rotation shaft of the transmitter/receiver apparatus is applied along the central shaft direction byway of vibrations or shocks and this force is stronger than the friction force of the rotation shaft of the transmitter/receiver apparatus along the central shaft direction, since the rotation shaft of the transmitter/receiver apparatus deviates from the bearing of the supporting base in response to the instantaneous camber of the supporting base, the conventional adjusting mechanism must be made rigid in order that this supporting base is not cambered. Thus, the sizes of the supporting base and the rotation shaft are increased.

As a second problem, when only one end of the transmitter/receiver apparatus is supported by the supporting base, the screw of the supporting base is loosened during the polarization angle adjustment and then the space is established between the rotation shaft of the transmitter/receiver apparatus and the bearing of the supporting base. As a result, there are risks that the transmitter/receiver apparatus would be inclined with respect to the electromagnetic wave radiation axis, or would dropped from the supporting base.

As a third problem, when the supporting base is manufactured by way of castings such as aluminum die-casting a casting with a taper is utilized in order that the bearing can be easily drawn from the casting. Thus, an inclination (drawing gradient) is made on the bearing. The supporting base has such a difficulty that when the edge portion having the larger diameter of this supporting base is mounted on the side of the transmitter/receiver apparatus, the rotation shaft can be easily dropped from the inclined bearing, whereas when this edge portion having the larger diameter of the supporting base is mounted in the reverse manner to the above mounting condition, the screw 8 for inserting the rotation shaft must be strongly fastened. On the other hand, it is conceivable that the casting is subdivided into right/left casting portions. However, in this case, there is another difficulty in that the center portion is narrowed, resulting in unstable supporting effects.

SUMMARY OF THE INVENTION

Accordingly, the present invention has been made to solve the above-described problems, and therefore, has an object to provide a polarization angle adjusting mechanism capable of readily mounting/adjusting a transmitter/receiver apparatus in an antenna apparatus equipped with a parabolic reflecting mirror.

Another object of the present invention is to provide a polarization angle adjusting mechanism capable of easily inserting, mounting, and adjusting a rotation shaft of transmitter/receiver apparatus with respect to the supporting base.

Another object of the present invention is to provide a polarization angle adjusting mechanism capable of firmly supporting the transmitter/receiver apparatus with a single supporting base under stable condition, and also of easily adjusting this transmitter/receiver apparatus.

A further object of the present invention is to provide such a polarization angle adjusting mechanism that the supporting base can be made compact, the rotation shaft of the transmitter/receiver apparatus would not be shifted, or deviate from the supporting base even upon receipt of vibrations, and also the transmitter/receiver apparatus would not be inclined with respect to the electromagnetic wave radiation axis during the adjustment of the polarization angle but also not be dropped from the supporting base.

A polarization angle adjusting mechanism, according to the present invention, is realized as follows. In a polarization angle adjusting mechanism comprising a transmitter/receiver apparatus equipped with a primary antenna having a rotation shaft used to adjust a polarization angle, a parabola antenna for radiating a transmission signal derived from said transmitter/receiver apparatus, and a supporting base having a cylindrical bearing for bearing said rotation shaft, for fixing said transmitter/receiver apparatus at a focal portion of said parabola antenna, in which the polarization angle of said primary antenna is adjusted by rotating said transmitter/receiver apparatus with respect to said supporting base, the polarization angle adjusting mechanism employs such a structure that at least one projection and at least one groove are provided on said rotation shaft and said bearing of said supporting base, and the respective projection and respective groove are mutually fitted to each other along a circumferential direction. Also, both said projection and said groove are provided on either a central portion of one of said rotation shaft and said cylindrical bearing of the supporting base, or an edge portion of one of said rotation shaft and said cylindrical bearing along the circumferential direction. The projection has at least one notch portion; and an inner portion of said groove is cut away, while a projection having a width narrower than that of said notch portion is left in correspondence with said notch portion. Furthermore, such a structure is employed that the rotation shaft is provided on either an outer peripheral portion of said primary antenna, or one end portion of said transmitter/receiver apparatus; and said transmitter/receiver apparatus is fixed by employing a single supporting base.

BRIEF DESCRIPTION OF THE DRAWINGS

The present invention will be explained in more detail in conjunction with the appended drawings, wherein:

FIG. 2 is a front view for representing the structure of the supporting base 7;

FIG. 3 is a front view for representing the structure of the transmitter/receiver apparatus 5;

DESCRIPTION OF THE PREFERRED EMBODIMENTS

Referring now to drawings, the present invention will be described.

Figure 1:
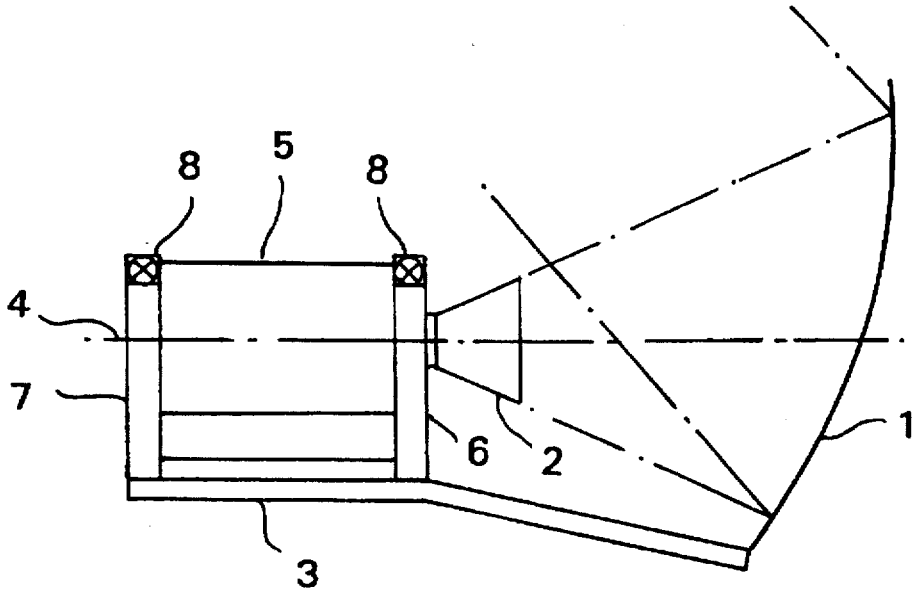
FIG. 1 (PRIOR ART)
FIG. 1 is a side view for showing the conventional antenna apparatus.
Figure 5:
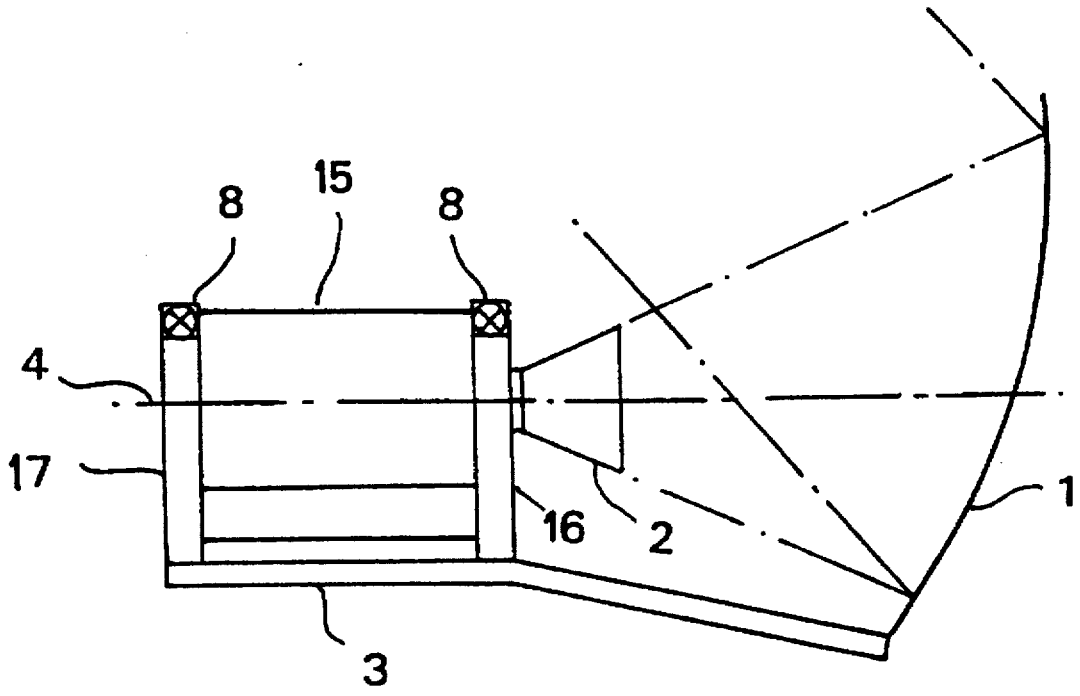
FIG. 5 is a side view for indicating an antenna apparatus according to an embodiment of the present invention.

A basic arrangement constructed of an antenna, a primary antenna, a transmitter/receiver apparatus, and a supporting base, according to an embodiment of the present invention, is illustrated in FIG. 5. As easily seen from FIG. 5, this structure is substantially the same as that of FIG. 1. That is, in FIG. 5, it is arranged by the transmitter/receiver apparatus 15 positioned at a focal portion of the antenna 1, constructed, or mounted with the primary antenna 2 in an integral form, and having rotation shafts for adjusting the polarization angle at both end portions on an electromagnetic radiation axis 4; the supporting bases 16 and 17 made in the same shapes, having 16 for accepting the rotation shafts of the transmitter/receiver apparatus 15, and for fixing the transmitter/receiver apparatus 15 at the focal portion of the antenna 1; and screws 8 provided on the supporting bases 16 and 17. The screws 8 tighten the cylindrical bearing 10 of the supporting base 17 against the rotation shaft 9 of the transmitter/receiver apparatus 15, and fix the polarization angle of the transmitter/receiver apparatus 15 in a constant position with respect to the antenna 1 by way of the friction force.

Figure 4:
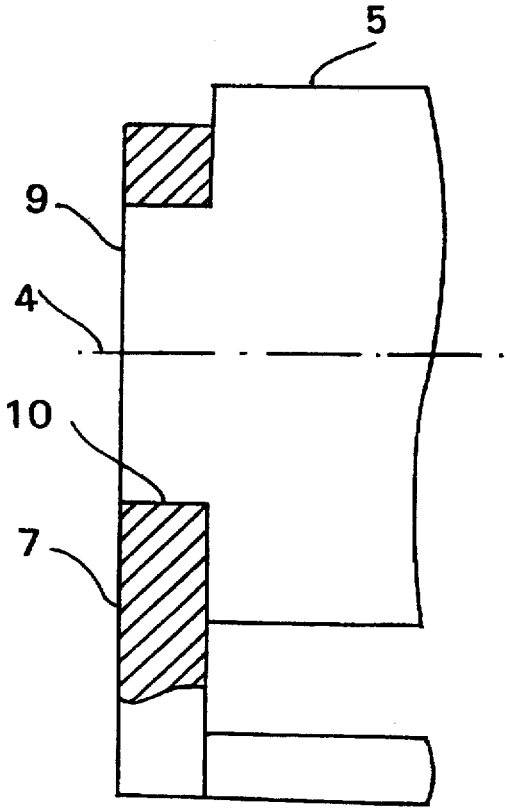
FIG. 4 (PRIOR ART)
FIG. 4 indicates the detailed mounting structure between the rotation shaft 9 and the supporting base 7 of FIG. 1.
Figure 6:
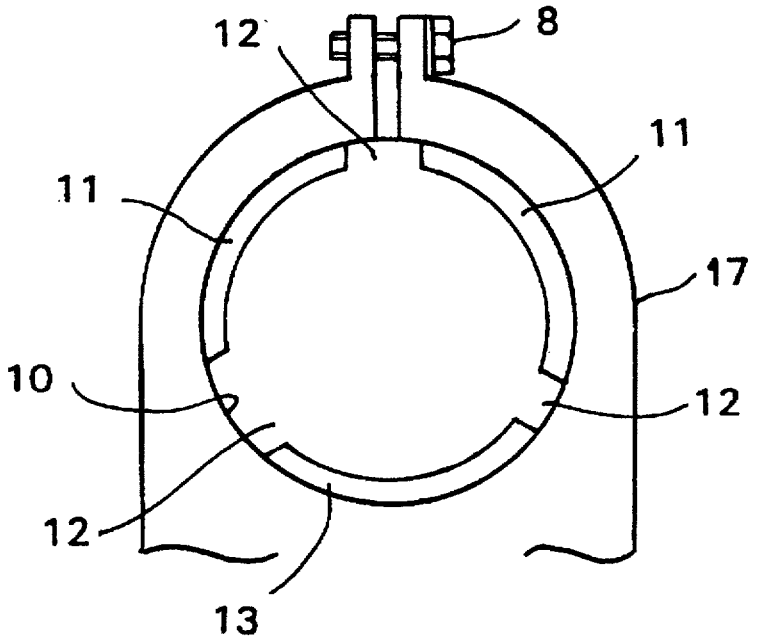
FIG. 6 is a front view for showing a structure of a supporting base 17.
Figure 7:
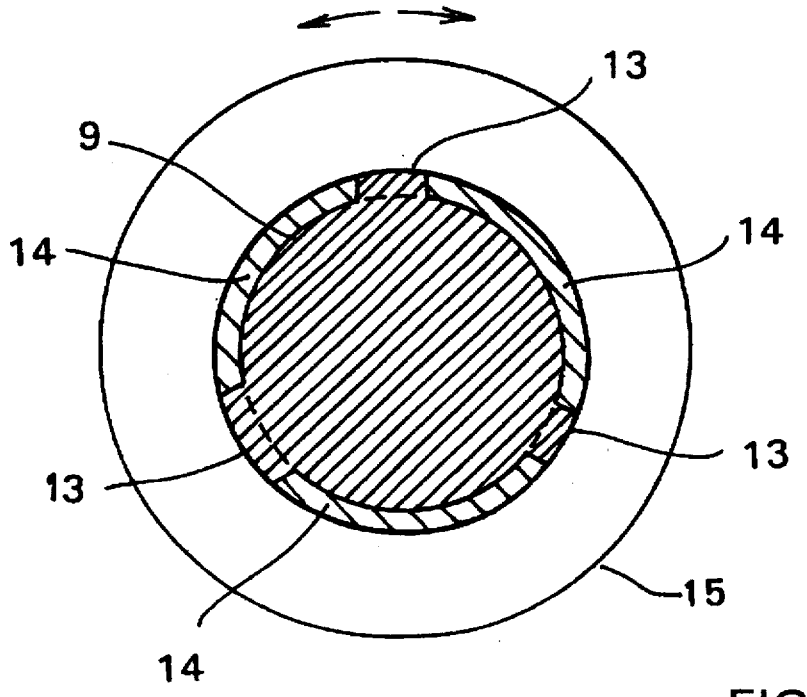
FIG. 7 is a front view for denoting a structure of a transmitter/receiver apparatus 15.
Figure 8:
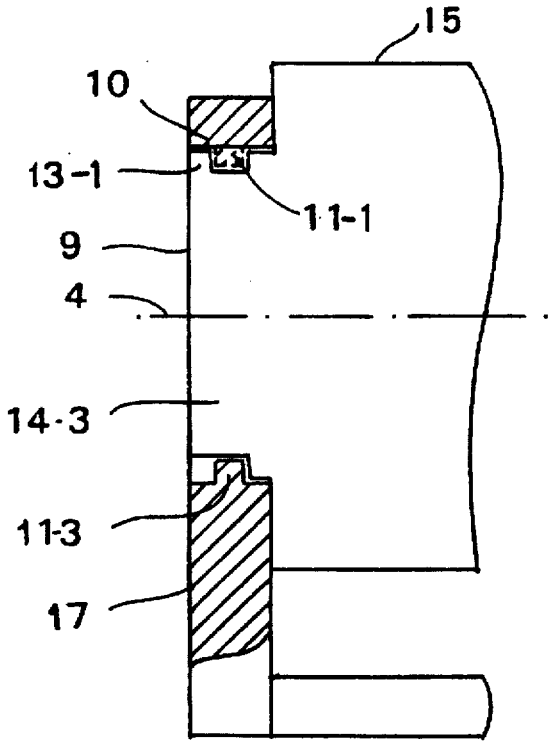
FIG. 8 represents a detailed mounting structure between a rotation shaft 9 and the supporting base 17 shown in FIG. 5.

With reference to FIGS. 6, 7 and 8 corresponding to FIGS. 2, 3 and 4, a description will now be made of the structures about the supporting bases and the rotation shafts of the transmitter/receiver apparatus, and also the fitting condition between the rotation shafts of the transmitter/receiver apparatus and the cylindrical bearings of the supporting bases, according to an embodiment of the present invention.

First, as indicated in the sectional view of FIG. 6 showing the supporting base 17 from the front view direction, the supporting base 17 has a bearing hole used to bear the rotation shaft about which the transmitter/receiver apparatus rotates, and also a screw 8 for fastening the rotation shaft. In the cylindrical bearing 10, three projections 11-1, 11-2, 11-3 are provided which are divided by three notch portions 12-1, 12-2, 12-3 at a center of the inner circumference plane of the cylindrical bearing 10, which have the individual lengths.

Also, as viewed along the back direction, the rotation shaft 9 of transmitter/receiver apparatus 15 is fitted to the cylindrical bearing 10 of the supporting base 16.

On the other hand, as represented in the sectional view of FIG. 7, the transmitter/receiver apparatus 15 has the rotation shaft 9 formed, or mounted with this transmitter/receiver apparatus 15 in an integral form. The frame portions of this rotation shaft 9 are cut away, while leaving projections 13-1, 13-2, 13-3 having widths narrower than those of the notch portions 12-1, 12-2, 12-3 provided on the cylindrical bearing 10 of the supporting base 17 in order that the projections 11-1, 11-2, 11-3 formed on the cylindrical bearing 10 of the supporting base 17 can be inserted into the side portion of this rotation shaft 9 to be inserted into the supporting base 17. See FIG. 8. Furthermore, there are provided grooves 14-1, 14-2, 14-3 formed in a center portion of the rotation shaft 9 along the thickness direction of the electromagnetic wave projection axis 4. These grooves 14-1, 14-2, 14-3 are fitted into projections 11-1, 11-2, 11-3 formed on the cylindrical bearing 10 of the supporting base 17, so that the transmitter/receiver apparatus 15 is freely rotatable with respect to the supporting base 17 around the electromagnetic wave projection axis 4 as a rotation center.

Then, the rotation shaft 9 of the transmitter/receiver apparatus 15 is mounted to the supporting base 17 in such a manner that under condition that the screw 8 of the upper portion of the supporting base is loosened, the portions of the notch portions 12-1, 12-2, 12-3 formed in the cylindrical bearing 10 of the supporting base 17 are made coincident with the positions of the projections 13-1, 13-2, 13-3 formed on the rotation shaft 9 of the transmitter/receiver apparatus 15 to be inserted thereto, and the transmitter/receiver apparatus 15 is rotatable with respect to the supporting base 17. FIG. 8 is a sectional view of the fitting condition between the supporting base 17 of FIG. 6 and the transmitter/receiver apparatus 15 of FIG. 7. As represented in FIG. 8, the projections 11-1, 11-2, 11-3 of the supporting base 7 are then fitted into the grooves 14-1, 14-2, 14-3 formed in the rotation shaft 9 of the transmitter/receiver apparatus 15 at a place other than the insertion position, and the screw 8 is again fastened.

Similarly, as to the transmitter/receiver apparatus 15 on the side of the primary antenna 2, the supporting base 16 is fastened to be fixed by the screw 8.

Figure 9:
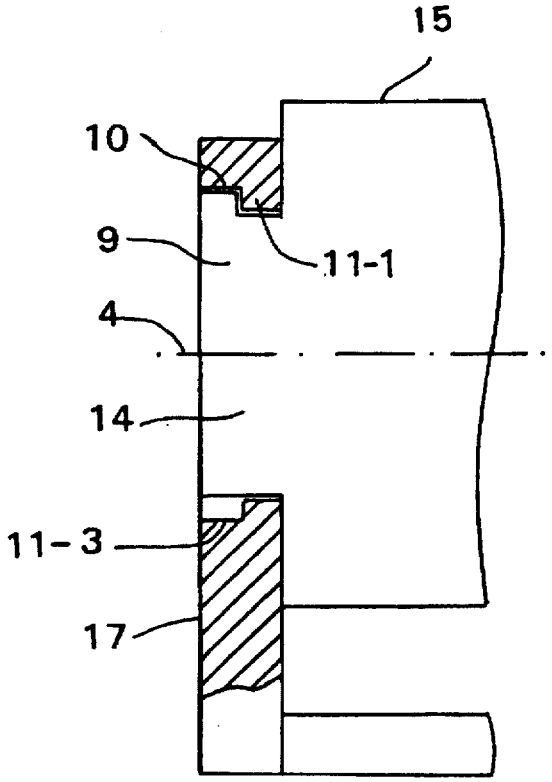
FIG. 9 illustrates another antenna apparatus according to another embodiment of the present invention.

In the above-described embodiment, the projections are formed at the central portion of the shaft receiving plane of the supporting base. However, the present invention is not limited thereto, may be applied to another embodiment of the present invention, as illustrated in FIG. 9. That is, both of the projections 11-1, 11-2, 11-3 and the notch portions are formed on the cylindrical bearing 10 of the supporting base 17 on the main body side of the transmitter/receiver apparatus 15. Between the projections 13-1, 13-2, 13-3 formed at the end portion of the rotation shaft 9 of the transmitter/receiver apparatus 15 and the main body of the transmitter/receiver apparatus 15, grooves 14-1, 14-2, 14-3 are formed.

Also, in the above-explained embodiment, such an example has been explained that the three notch portions 12-1, 12-2, 12-3 formed in the cylindrical bearing 10 of the supporting bases 6 and 7 have different widths from each other, and further the three projections 13-1, 13-2, 13-3 formed on the rotation shafts of the transmitter/receiver apparatus 15 have individual widths. This is a relatively simple arrangement, and thus has such an effect to prevent the rotation shafts of the transmitter/receiver apparatus from falling out of the supporting bases. However, the present invention is not limited to this embodiment, but may be modified in that these notch portions and projections have the same widths, respectively. Alternatively, such a structure may be employed with only one projection and one notch portion. Moreover, both of the above-described grooves and projections may be formed on the cylindrical bearing 10 of the supporting base 7, and also notch portions 12-1, 12-2, 12-3 and projections 11-1, 11-2, 11-3, may be formed in the rotation shaft 9 of the transmitter/receiver apparatus 15.

As described above in accordance with the polarization angle adjusting mechanism of the present invention, since the transmitter/receiver apparatus can be surely mounted and adjusted, the transmitter/receiver apparatus may be mounted/fixed with only one end portion thereof by way of the two supporting bases, instead of the both end portions thereof. Also, the rotation shafts 9 are not limited to be provided at the end portions of the transmitter/receiver apparatus, but may be provided at the outer peripheral portion of the primary antenna 2, and only the rotation shaft thereof may be mounted by the supporting bases so as to be adjusted. Moreover, the rotation shafts 9 may be mounted on the supporting bases at two positions selected from three positions, namely the outer peripheral portion of the primary antenna 2 and both ends of the transmitter/receiver apparatus, otherwise at all three positions, if required. If, such a structure to mount the rotation shafts at more than two positions is used, it is apparent that the above-explained projections and grooves provided on the supporting bases and the rotation shafts may be provided on at least one of the supporting base and the rotation shaft.

While the present invention has been described in detail, since the projections and the grooves fitted to these projections along the circumferential direction of the rotation shaft are provided on the rotation shafts of the transmitter/receiver apparatus, and also the cylindrical bearing of the supporting bases, the below-mentioned various advantages can be achieved.

For example, as a first advantage, even when the force caused by vibrations or shocks is applied along the central axis direction of the rotation shaft of the transmitter/receiver apparatus, since the rotation shafts of the transmitter/receiver apparatus are not shifted from the cylindrical bearings of the supporting bases, the supporting bases can be made compact and simplified.

Secondly, even when only one end portion of the transmitter/receiver apparatus is supported by the supporting base, the space defined between the grooves and the projections along the electromagnetic wave radiating axial direction is made small, so that the inclination with respect to the electromagnetic wave radiating axial direction can be decreased to a small value, and also dropping of the rotation shafts from the supporting bases can be avoided.

Thirdly, even when the supporting bases are manufactured by employing such a casting as a die-casting with a drawing inclination, the stable and firm mounting/adjusting/fixing effects can be achieved as to the rotation shafts and the cylindrical bearings.

What is claimed is:

1. A polarization angle adjusting mechanism comprising:

a transmitter/receiver apparatus equipped with a primary antenna having a rotation shaft used to adjust a polarization angle;

a parabola antenna for radiating a transmission signal derived from said primary antenna; and a supporting base having a cylindrical bearing for bearing said rotation shaft, for fixing said transmitter/receiver apparatus at a focal portion of said parabola antenna; wherein:

the polarization angle of said primary antenna is adjusted by rotating said transmitter/receiver apparatus with respect to said supporting base, said polarization angle adjusting mechanism further comprising:

at least one first projection and at least one notch portion provided on one of said cylindrical bearing of said supporting base and said rotation shaft and at least one second projection and at least one groove provided on the other one of said cylindrical bearing of said supporting base and said rotation shaft, both said first projection and said groove and both said second projection and said notch portion being mutually fitted to each other along a circumferential direction as said transmitter/receiver rotates.

2. A polarization angle adjusting mechanism, according to claim 1, wherein:

said first projection, said notch portion, said second projection and said groove are provided on either a central portion of one of said rotation shaft and said cylindrical bearing of the supporting base, or an edge portion of one of said rotation shaft and said cylindrical bearing.

3. A polarization angle adjusting mechanism, according to claim 2, wherein:

an inner portion of said groove is cut away, while a projection having a width narrower than that of said notch portion is left in correspondence with said notch portion.

4. A polarization angle adjusting mechanism, according to claim 1, wherein:

said rotation shaft is provided on either an outer peripheral portion of said primary antenna, or one end portion of said transmitter/receiver apparatus; and said transmitter/receiver apparatus is fixed by employing a single supporting base.

5. A polarization angle adjusting mechanism, according to claim 1, wherein:

said rotation shaft is provided on at least two positions selected from an outer peripheral portion of said primary antenna and the end portion of the transmitter/receiver apparatus; and said transmitter/receiver apparatus is fixed by employing at least two supporting bases.

6. A polarization angle adjusting mechanism, according to claim 5, wherein:

said first and second projections and said groove are provided on at least one rotation shaft and one supporting base.

7. A polarization angle adjusting mechanism according to claim 1, wherein the rotation shaft is fitted to the cylindrical bearing in an initial position such that the second projection is received in the notch portion and the first projection is received in the groove, and the rotation shaft is rotated to a second position different than the initial position so that second projection is opposed to the first projection, thereby preventing axial movement of the shaft and preventing the shaft from falling out of the bearing.

8. A polarization angle adjusting mechanism according to claim 7, further comprising a tightening screw for clamping the bearing about the shaft in the second position.

9. A polarization angle adjusting mechanism according to claim 1, wherein the first projection and notch portion are provided on the cylindrical bearing and the second projection and groove are provided on the rotation shaft.

* * * * *